US005312567A

United States Patent [19]

Kozma et al.

[11] Patent Number: 5,312,567

[45] Date of Patent: May 17, 1994

[54] COMPLEX MIXER FOR DISPERSION OF GASES IN LIQUID

[75] Inventors: László Kozma; Sándor Kováts, both of Budapest; Béla Makádi, Debrecen; László Cséke, Debrecen; Sándor Pusztai, Debrecen; Mihály Kaszás, Debrecen; György Sántha, Debrecen; István Barthó, Budapest; Károly Zalai, Budapest; Gyula Beszedics, Budapest; Gabriella Kordik, Budapest; Károly Gergely, Budapest; Miklós Féder, Budapest, all of Hungary

[73] Assignee: Richter Gedeon Vegyeszeti Cyar Rt., Budapest, Hungary

[21] Appl. No.: 930,515

[22] Filed: Sep. 25, 1992

[30] Foreign Application Priority Data

Feb. 1, 1991 [HU] Hungary ..... 364/91

[51] Int. Cl.[5] ..... B01F 3/04

[52] U.S. Cl. ..... 261/87; 261/93

[58] Field of Search ..... 261/87, 93

[56] References Cited

U.S. PATENT DOCUMENTS

| | | | |
|---|---|---|---|
| 134,706 | 1/1873 | Schultze | 261/93 |
| 988,272 | 3/1911 | Lee | 261/93 |
| 1,579,355 | 4/1926 | Greenawalt | 261/87 |
| 2,187,746 | 1/1940 | Leferre | 261/87 |
| 3,092,678 | 6/1963 | Braun | 261/87 |
| 3,482,520 | 12/1969 | Larsen | 261/87 |
| 3,512,762 | 5/1970 | Umbricht | 261/87 |
| 3,625,834 | 12/1971 | Muller | 261/93 |
| 3,677,528 | 7/1972 | Martin | 261/87 |
| 3,969,446 | 7/1976 | Franklin, Jr. | 261/87 |
| 4,240,905 | 12/1980 | Scaccia | 261/93 |
| 4,594,228 | 6/1986 | Lambert, Jr. et al. | 261/93 |
| 4,699,740 | 10/1987 | Bollenrath | 261/93 |
| 4,896,971 | 1/1990 | Weetman et al. | 261/93 |
| 4,955,586 | 9/1990 | Onizuka et al. | 261/87 |
| 5,073,311 | 12/1991 | Nojima et al. | 261/93 |
| 5,102,630 | 4/1992 | Lee | 261/93 |

FOREIGN PATENT DOCUMENTS

| | | | |
|---|---|---|---|
| 506758 | 11/1951 | Belgium | 261/93 |
| 0021470 | 1/1981 | European Pat. Off. . | |
| 1230399 | 12/1966 | Fed. Rep. of Germany | 261/87 |
| 53-25272 | 3/1978 | Japan | 261/87 |
| 0680763 | 8/1979 | U.S.S.R. | 261/87 |
| 0738649 | 6/1980 | U.S.S.R. | 261/87 |

OTHER PUBLICATIONS

R. Steel et al; Biotechnology and Bioengineering; vol. IV; "Some Effects of Turbine Size on Novobiocin Fermentations".

*Primary Examiner*—Tim Miles

*Attorney, Agent, or Firm*—Herbert Dubno

[57] ABSTRACT

Complex mixing system with stages consisting of propeller mixers of high diameter ratio, where the blades are provided with flow modifying elements, whereby the energy proportions spent on dispersion of the amount of gas injected into the reactor, homogenization of the multi-phase mixtures, suspension of solid particles, etc. and the properties corresponding to the rheological properties of the gas-liquid mixtures and to the special requirements of the processes can be ensured even in extreme cases. Open channels (5) opposite to the direction of rotation are on the blades (4) of the dispersing stage (2*a*) of the propeller mixers (2) fixed to a common shaft, where the channels (5) are interconnected with gas inlet (7). The angle of incidence of a certain part of the blades (4) of mixing stages (2*b*, 2*d*) used for homogenization and suspension is of opposite direction and the length is shorter and/or the angle of incidence is smaller than those of the other blades. Baffle bars (8) are on the trailing end of the blades on a certain part (2*c*) of the propeller mixers used similarly for homogenization and suspension, and/or auxiliary blades (12) at an angle of max. 20° to the blade wings are arranged above or below the trailing end of the blades (FIG. 1 and 6).

7 Claims, 2 Drawing Sheets

COMPLEX MIXER FOR DISPERSION OF GASES IN LIQUID

CROSS REFERENCE TO RELATED APPLICATIONS

This application is a National Phase of PCT/H 92/00005 filed Jan. 31, 1992 and based, in turn, upon Hungarian National Application 364/91 filed Feb. 1, 1991 under the International Convention.

FIELD OF THE INVENTION

Our present invention relates to a complex mixer for the dispersion of gases in liquid and for mixing the resulting mixture intensively in cylindrical reactors with a vertical shaft, mainly in bioreactors containing mixing propeller blades fixed to the common vertical shaft of the apparatus.

BACKGROUND OF THE INVENTION

At the present time the so called Rushton turbomixer, rotated by a shaft centrally arranged in the fermenter, and consisting of 6 rectangular straight blades radially fixed to a circular plate is mainly used in bioreactors (fermenters). If the height of the bioreactor is multiple of the diameter, a system consisting of 2–4 turbomixers fixed to a common shaft is used.

The air to be dispersed is injected below the lower mixer through a perforated loop expansion pipe, nozzles, or a central nozzle (Fejes, G.: Industrial mixers, p 52–55).

The turbomixers usually make up ⅓ of the diameter of the fermenter and disperse the air efficiently by the intensive turbulence and shear forces generated around the row of blades. Because of the high local energy dissipation, despite the high specific power consumption of the turbomixers, the proportion of energy invented in the zones farther from the mixer is minimal, and the axial transport capacity of the mixer is low, which causes problems increasing as the volume of the bioreactors grows.

There are also known two winged or multi-winged propeller mixers with inclined blades or blades according to the geometry of a helical surface. The mixing system is built up from these mixers.

SEM type mixers utilize the flow properties of the thin propeller wings. EKATO mixers utilize the interference phenomena of parallel double wing blades arranged at an angle and at a spacing above each other (Interming and Interprop mixers, Fejes, G.: Industrial mixers, p 65).

The energy dissipation of propeller mixers with large diameter ratio compared with the diameter of the fermenter is more uniform, and the axial transport capacity is high. Therefore, with the same power consumption they can mix the liquid more efficiently and evenly in high fermenters, but their dispersion capacity is reduced. This is counterbalanced by the use of several phases.

Suction mixers, consisting of hollow mixing elements fixed to a rotating tubular shaft suitable for mixing, dispersion and partly for transport of the gas, are also known. The hollow mixing elements are mostly pipes cut at an angle of 45°. At the ends of these pipes, at an adequate speed, pressure drop occurs, sucking in the gas usually through the hollow tubular shaft. The gas is atomized by the shear forces generated in the liquid by the sharp pipe-ends (Fejes, G.: Industrial mixers, p 57).

These mixers are not used in the fermenting industry because of their limited suction capacity. Such suction mixers are also known, where the hollow elements are nearly semi-circular channels open on the side opposite the direction of advance, and at a diameter which is nearly the same as that of the container. Thus they are suitable for the atomization of relatively large amount of gas. However, because of their low circulation capacity, they are used only in the yeast industry and sometimes in processes not requiring intensive mixing of the liquid.

The purpose of mixing in the reactors is the homogeneous distribution of the solid, liquid and gaseous phases for intensification of the material and heat transfer processes. As a result of mixing, significant velocity, gradients and turbulence are caused in the space between the mixing elements and the reactor wall provided with baffle plates. In the case of fermentation processes, the turbulence proportional to the velocity gradient and shear forces increase the dispersiveness of the injected air bubbles, and reduce the thickness of the boundary layers between the microorganisms, culture medium and air bubbles, thereby improve and speed up the material- and heat transfer processes taking place on the boundary surfaces of the phases.

A three-phase system of the microorganisms, culture medium and injected air can be brought about in the bioreactors, where the flow space and its effect on the transfer of material are made extremely complicated by the various interactions, such as a change in the rheological properties of the fermenting liquid in consequence of the metabolism of the microorganisms. The problem is further complicated by diversity and contradictions of the requirements. E.g. in a significant part of the fermentation processes intensive turbulence and shear are required for dispersion of the air and oil droplets, microblending the culture medium and biomass and cutting up the agglomeration. At the same time, however, the intensive mixing facilitates the formation of stable foams which partly directly and partly as a result of the use of foam-inhibiting materials reduces the oxygen transfer, and aeration of the carbon dioxide, and may mechanically damage the microorganisms, or may bring about production-reducing morphological changes.

It is a characteristic of the complexity of the mixing processes taking place in the bioreactors, that each basic operation: dispersion, suspension, dissolution, homogenization, etc. has an important role in the processes, i.e. essentially each fermentation process has its associated specific requirements which can differ significantly according to the type and strain. Thus, the effects of the basic operations should remain within relatively narrow limits in order that, besides affording the required beneficial effect, the adverse effects should remain minimal. In respect of the turbomixers used in the majority of the bioreactors, it is equally unfavorable to expend the major proportion of the mixing energy for the generation of turbulence, so that dissipation about 70% of the mixing energy takes place in the immediate vicinity of the turbine blades, and these conditions can be changed only to a minor degree.

In the case of fermenting liquids forming intensively aerated viscous and stable foams of non newtonian properties, the circulation and turbulence generated by small diameter turbomixers may decrease relatively quickly. The circulation could be intensified by increasing the turbomixer's diameter, but this is limited by the disproportionate growth of the mixing power, which—according to the known relationship—increases with the 5th power of the mixer's diameter. Therefore, the diameter of the turbomixer must not exceed 40% of the apparatus even in case of small fermenter with a volume below 40 $m^3$. Thus their characteristic feature is the small diameter ratio. On the other hand, this causes additional problems, as the reactor volume and viscosity of the fermenting liquid are increased in the wake of insufficiently mixed zones.

The diameters of propeller mixers—with regard to their much lower rate of power input—may approach the diameter of the reactor. Therefore, the use of propeller mixers of high diameter ratio making up 60–70% of the apparatus' diameter is becoming widespread in bioreactors, although the dispersion capacity is lower because they are more suitable for the efficient mixing of the viscous fermenting liquids.

To provide an efficient mixer is difficult because properties of the viscous fermenting liquids containing microorganisms and air bubbles are often extremely different from those of Newtonian liquids. Some scientists have found that the turbomixer with smaller diameter is capable of an 8-times higher rate of oxygen absorption, than the turbomixers of greater diameter with the same energy input, although such differences cannot be detected in clear water (Steel, R.-Maxon, W. D.: Biotechn. and Bioeng. 2, 231, 1962). These incompletely understood phenomena dependent on the properties of cultures and composition of the culture media also justify the construction of mixing systems, whose mixing effect can be controlled within wide limits and can be modified in respect of every mixing operation.

On the other hand, a common characteristic of the described mixers is that any of them is suitable for producing mainly a certain mixing effect which could limit optimization of the processes.

The efficiency of the mixing for the apparatus depends on the magnitude of the introduced energy and construction of the mixing system. The dissolved oxygen concentration can be improved to the required level generally with the known mixers by increasing the amount of mixing energy and the injected air. However, the disproportionately increasing demand for energy and its cost, intensification of the foam formation and impairment of the microorganisms may increasingly limit the economic factors with the increasing dimensions of the reactor.

The known multi-stage turbine consisting usually of the same elements, and other mixing systems in consequence of the mentioned capabilities and restrictions of the constructions do not provide adequate flexibility for satisfying the specific requirements of the various microorganisms.

OBJECT OF THE INVENTION

Due to the growing dimensions of the bioreactors, the described circumstances require optimization of the mixing aerating systems to an increasing degree, which is the object of the present invention.

SUMMARY OF THE INVENTION

Accordingly, the invention provides a complex mixer which contains propeller mixers with a high diameter ratio, fixed to a common vertical mixing shaft, and having open channels opposite the direction of rotation. These channels are on the blades, hereinafter primary blades, of at least one of the mixers. The channels are interconnected with the gas inlet. The angle of incidence of a certain part of the other secondary propeller mixing blades is in an opposite direction and their length and angle of incidence are less compared with the other blades.

Turbulence intensifying baffle bars are mounted on the edges of the primary and secondary mixing blades or on part of them.

The gas passing through the hollow mixer hub into the channels on the primary mixing blades of the mixing system according to the invention is drawn in and finely dispersed along the whole length of the channels and blades by the suction and turbulence arising on the suction side of the wing blades forcing the liquid to intensively flow axially. The gas is entrained in an efficient axial flow and accelerated by the propeller wings.

Construction of the primary propeller mixers according to the invention is based on the recognition that with the aid of channels on the blades, the gas can be finely dispersed on a large surface without additional energy, and it can be evenly mixed into the whole mass of the flowing liquid. Thus, the mixing system utilizes the major part of the energy for circulation of the gas and liquid mixture, which is a significant advantage with respect to the system's power consumption.

The gas is conducted conventionally through the hollow shaft to the hollow hub of the primary mixer, or in another way then a pipeline conducts the gas into the mixer hub machined as a cylinder open at its lower end.

The air suction-dispersing channels of the primary mixer are arranged suitably over the full lengths of the blades along their trailing edges, but they can be arranged (generally with less efficiency) on another part of the blades, even in the vicinity of the blades, where the dispersing effect of the flow accelerated by the blades still does not prevail. This distance is about twice the width of the channel, thus to mount the channels farther would not be practical. To minimize the complexity of the construction it is an advantage that the blades, joined but several points with the channels, constitute a rigid system which better resists the resonance phenomena leading to breakage of relatively long and thin blades.

The gas to be dispersed is conducted into the bioreactor below the lower mixer with the aid of a perforated loop expansion pipe or nozzles. In the case of several hundred cubic meter capacity bioreactors, the air is transported under high pressure. A further important recognition relating to the mixing system according to the invention is that the primary mixer performing the primary dispersion can be arranged as a higher stage, whereby not only the compression work can be reduced, but the path of air bubbles can be lengthened which can improve the material transfer. This arrangement is not realizable for the known reasons either in case of turbomixers or suction mixers.

According to the invention, the weaker flow of opposite direction generated by the blades with opposite transporting direction and lower transporting capacity, i.e. smaller angle of incidence and/or shorter blades of the secondary propeller mixers performing the intensive circulation of the gas-liquid mixture and the secondary dispersion of each gas bubble results in series of vortices impacting the main flow, whereby the energy dissipation becomes more uniform, than with the series of vortices generated at the thin blade-ends of the conventionally used turbomixers. Intensity of the so generated vortex series is variable within wide limits by altering the angle of incidence and/or the length of wing blades.

Thus, contrary to the restrictions of the traditional turbomixers, the proportion of the amounts of energy spent on circulation and generation of turbulence is variable at will with this specific blade arrangement, and the low dispersing capacity of the traditional propeller mixers can also be improved as necessary. In many cases the result is more favorable with the use of this system compared with the traditional systems.

The dispersion effect of the secondary propeller mixers can also be improved if the propeller wings of smaller angle of incidence and/or smaller diameter generated weaker counterflow constitute separate stage and are mounted alternately on the mixing shaft with secondary propeller mixers provided with blade wings of higher transport capacity, thus with greater angle of incidence and/or greater diameter generating the main flow. With this solution however, fewer impact zones are realizable.

The dispersion capacity of the wing blades of propeller mixers can be further improved as needed with baffle bars fixed to their trailing ends. It has been found that the baffle bars generate vortex series of an intensity adjustable within wide limits by their width, which however, follow the main flow direction of the mixture, and in this way facilitate the dispersion and mixing of the components without reducing adversely the mixing of fermenting liquid.

The dispersion capacity of the blades can be similarly improved with auxiliary wings exceeding ⅓rd of the width of blades arranged below or above the air dispersing channels. Altering appropriately the angle of incidence of these auxiliary wings in relation to the blades, the velocity of the liquid-gas mixture passing between them and between the blade can be altered within wide limits, whereby turbulence of the flow generated by both the primary and secondary mixers can be further intensified. In case of the primary blades, acceleration of the flow and its consequences: the suction effect, intensification of the turbulence and dispersion capacity take place with the auxiliary wings fixed parallel with the blades, because the channels narrow the cross section between the blades and auxiliary blades.

In some less demanding cases the blades of the propeller mixers can be shaped as inclined plates at acute angle to the direction of rotation, instead of the geometrical helical surface used in the propeller mixers. In this cases the angle of incidence of the blades can be reduced incidentally in several stages. Naturally, intensification of the turbulence has to be reckoned with in any case.

The different versions of the complex apparatus according to the invention allow the adaptation of the mixing systems to the extremely different proportions and requirements of the various cultures of microorganisms.

Thus for example in the case of intensive foaming of fermenting liquids, which inhibits the transfer of $O_2$ and the material, the uses of a system consisting of a primary mixer with a suction channel and secondary propeller mixers without wing blades of opposite direction might be more favorable. On the other hand, in case of less foaming fermenting liquids of low viscosity, requiring little mixing, the use of a system consisting only of secondary mixers would be sufficient.

In the majority of the known fermentation processes however, a complex system consisting only of primary and secondary mixers ensures the optimal conditions for the transfer of material.

With the complex mixing systems according to the invention every mixing basic operation determining the material transfer, such as energy proportions expended on the generation of circulation and turbulence can be evenly distributed in the whole volume of the gas-liquid mixture and the given processes can be optimized even in extreme cases according to the proportions corresponding to the specific requirements.

With the suitable construction of the opposite directional wing blades of the mixers according to the invention and with regulation of the intensity of vortex series facilitating the mixing—besides optimizing the uniform transfer of material—damage to the microorganisms is avoidable.

BRIEF DESCRIPTION OF THE DRAWING

Further details of the invention will be described more in details by way of example with reference to the accompanying drawing in which.

DESCRIPTION

Figure 1:
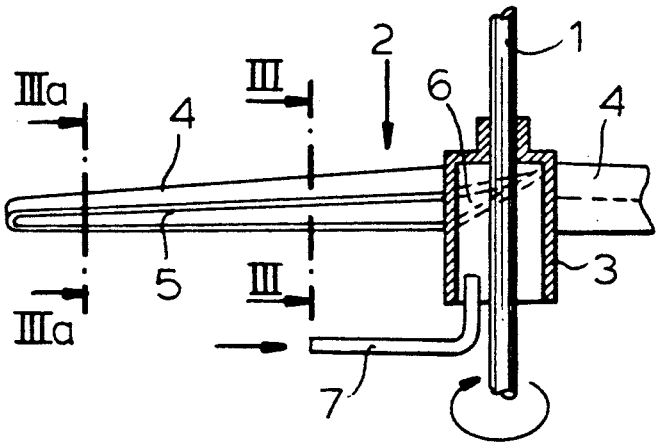
FIG. 1 is a detail in section of the mixer according to the invention.
Figure 3A:
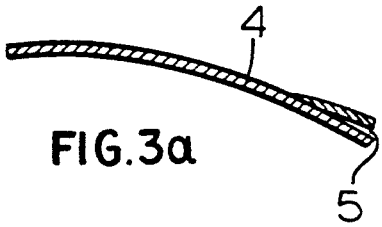
FIG. 3*a* is a section along line IIIa—IIIa of FIG. 1.
Figure 3:
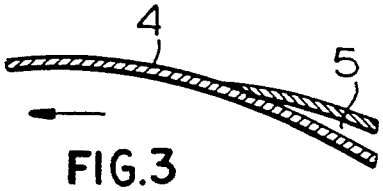
FIG.3 is section along line III—III of FIG. 1.
Figure 2:
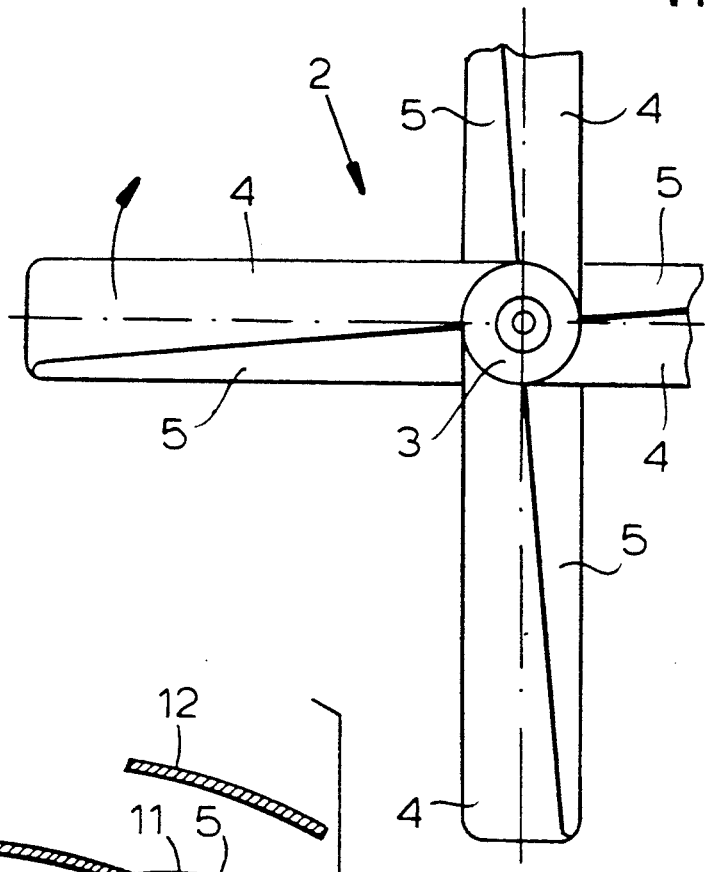
FIG. 2 is a top view of the mixer of FIG. 1.

FIGS. 1 to 3 show a mixing element of the apparatus according to the invention. The propeller mixer 2 fixed to mixing shaft 1 of the bioreactor consists of blades 4 arranged on hub 3. Channels 5 are machined on the back (trailing) sides of blades 4. These are interconnected through holes 6 in the hub wall with the interior of the hollow hub 3.

The gas passes through a gas inlet 7 into the hollow hub 3 and from there through holes 6 into channels 5.

Figure 4:
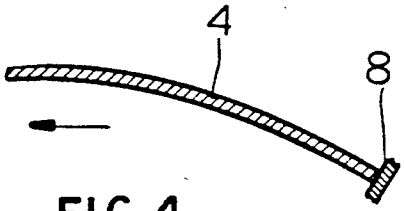
FIG. 4 is a section of a blade with a buffer bar.

FIG. 4 shows a baffle bar 8 fixed to the end of blades 4.

Figure 5:
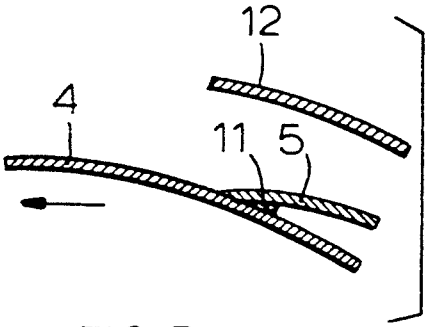
FIG. 5 is a section of a blade with an auxiliary ring.

FIG. 5 shows a section of mixing blade 4 illustrated in FIG. 1, the channel 5 welded 11 to the blade and auxiliary blade 12 fixed parallel with and above the blade at a distance of 0.3 times the blade width.

The drawing demonstrates the acceleration of the flow rate between the two parallel blades caused by narrowing the flow cross section by channel 5.

Figure 6:
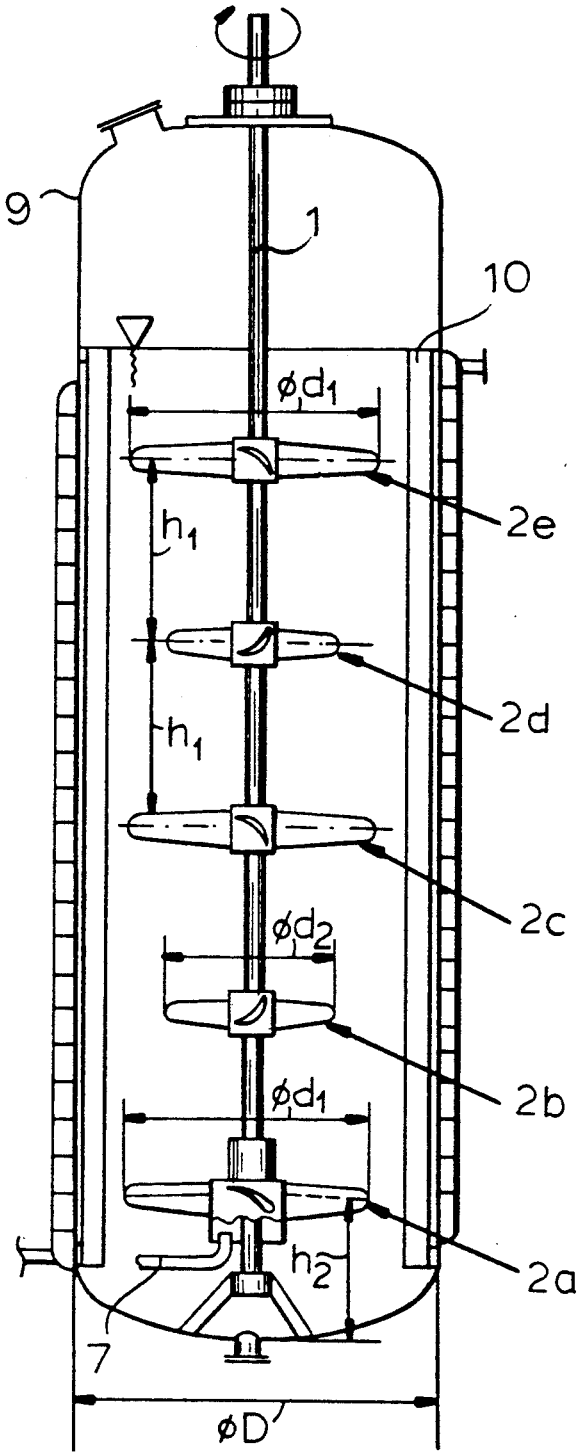
FIG. 6 is a vertical section through the bioreactor according to the invention.

FIG. 6 illustrates a practical embodiment of the apparatus according to the invention. Here the mixing shaft 1 is centrally arranged in the bioreactor 9 together with five four blade propeller mixers 2*a*–2*e*.

The gas inlet 7 is arranged at the lower propeller mixer 2*a*. Construction of this primary propeller mixer 2*a* is the same as the one shown in FIGS. 1 to 3, its diameter $d_1$ is 70% of the bioreactor's diameter D, its transport is downwards. Further, four secondary propeller mixers 2*b*–2*e* are arranged on the mixing shaft 1. The diameter $d_1$ and direction of transport of propeller mixers 2*c* and 2*e* are the same as those of the primary propeller mixer 2*a*, the other two propeller mixers 2*b* and 2*d* have two downward transporting blades with diameter $d_1$, i.e. 0.7 D and two upward transporting blades with diameter $d_2$, i.e. 0.5 D. The distance $h_1$ between propeller mixers 2*d* and 2*e* is 70% of the diameter of the longer propeller mixers.

Baffle bars 8 are fixed to the blades of the central propeller mixer 2*c*, their width is 3% of the propeller mixer's diameter.

The above described mixing system is suitable for mixing and aeration of the fermenting liquids of medium foaming capacity requiring medium mixing intensity.

Tests were conducted with the apparatus according to the invention, in the course of which the complex mixing system—in respect of the characteristic hydromechanical parameters, time of homogenization, dispersion capacity and "hold up" of the gas—was found to be more favorable compared with the traditional Rushton turbomixers.

The measurements took place in clear water and intensively foaming culture medium. Surprisingly, in spite of better dispersion, the rate of foaming was lower than in the case of turbomixers, which is probably the consequence of more uniform energy dissipation.

This is highly significant with respect of the output of the fermentation processes, as the foam-inhibiting materials generally reduce the material transfer.

Based on the described principles, the mixing system can be built up in many ways, and their advantage is just the complexity and variability. However, their efficient operation requires to conform to certain proportions:

The diameter of the mixers with high diameter ratio generating usually downward flow is 50–70% and the diameter of the blades with lower transport capacity generating counter-flow is 40–60% of the reactor's diameter. Distance between the mixers is 50–100% of the diameter of the mixers with high diameter ratio. Width of the baffle bars is 3–6% of the mixer diameters.

The complex mixer according to the invention—depending on the circumstances—as a result of the improved hydraulic efficiency is capable to speed up the intensity of the process in the case of chemical processes, thereby to increase the capacity, incidentally to reduce the quantity of a component taking part in the process, furthermore to improve the output and/or to reduce the specific mixing energy utilization in case of the biological processes.

The above examples are only for illustration of the invention, and it will be understood that the apparatus is susceptible to various modifications within the scope claimed.

We claim:

1. A mixer for dispersing a gas in a liquid, comprising:

a generally cylindrical vessel having a substantially vertical axis and receiving a body of liquid to be mixed with a gas;

a shaft extending along said axis and rotatable in said vessel;

a gas-dispersing primary propeller mixer on said shaft at a lower portion of said vessel and including:

a downwardly open hub on said shaft, a plurality of primary blades extending radially from said hub and formed with respective channels open rearwardly of each primary blade with respect to a direction of rotation thereof by said shaft, said channels opening along trailing edges of said primary blades and being of increasing cross section from tips of said blades to said hub, said hub having bores communicating between said channels and an interior of said hub;

a plurality of secondary propeller mixers spaced apart above said gas-dispersing propeller mixer along said shaft, said secondary propeller mixers having radial secondary blades extending from said shaft and rotatable thereby, the secondary blades of at least one of said secondary propeller mixers being shorter than the secondary blades of another of said secondary propeller mixers and shorter than said primary blades, at least one of said secondary propeller mixers below an uppermost secondary propeller mixer being formed with at least one flow modifier selected from baffle bars on trailing edges of the secondary blades thereof and secondary blades with inclinations opposite those of other secondary blades, said uppermost secondary propeller mixer having channel-free and flow-modifier-free blades of the same length from the axis as the primary blades; and a gas-inlet pipe opening upwardly into said hub for feeding gas to said hub and from said hub into said channels.

2. The mixer defined in claim 1 wherein said channels are formed in said primary blades.

3. The mixer defined in claim 1 wherein said channels are formed between a surface of said primary blades and a formation extending in spaced relation to said surface.

4. The mixer defined in claim 1 wherein said modifiers are baffle bars on said trailing edges and of a width which is 3 to 6% of the diameter of said primary propeller mixer.

5. As defined in claim 1 wherein said flow modifiers are ancillary wings juxtaposed with said secondary blades.

6. The mixer defined in claim 1, further comprising ancillary wings spaced from at least some of said blades and forming flow intensifying slots between them.

7. The mixer defined in claim 6 wherein the width of each ancillary wing is at least 30% of the width of the blade with which it is juxtaposed, said blades and the respective wings having an angle between them of a maximum of 20°.

* * * * *